US009520111B1

(12) United States Patent
Clissold

(10) Patent No.: US 9,520,111 B1
(45) Date of Patent: Dec. 13, 2016

(54) MUSICAL INSTRUMENT AND METHOD OF ASSEMBLING SAME

(71) Applicant: NUVO INSTRUMENTAL (ASIA) LTD, Kennedy Town (HK)

(72) Inventor: Maximilian Spencer Clissold, Kennedy Town (HK)

(73) Assignee: NUVO INSTRUMENTAL (ASIA) LTD, Kennedy Town (HK)

( * ) Notice: Subject to any disclaimer, the term of this patent is extended or adjusted under 35 U.S.C. 154(b) by 0 days.

(21) Appl. No.: 14/968,436

(22) Filed: Dec. 14, 2015

(51) Int. Cl.
*G10D 7/08* (2006.01)

(52) U.S. Cl.
CPC ..... *G10D 7/08* (2013.01)

(58) Field of Classification Search
CPC ..... G10D 7/08
See application file for complete search history.

(56) References Cited

U.S. PATENT DOCUMENTS 2,471,290 A * 5/1949 Sommaruga ..... G10D 7/08 84/385 R
2,551,177 A * 5/1951 Sommaruga ..... G10D 7/08 84/385 R
2,570,354 A * 10/1951 Loney ..... G10D 7/08 84/385 R
3,375,746 A * 4/1968 Proll ..... G10D 9/043 446/208
3,521,517 A * 7/1970 Sato ..... G10D 9/02 84/383 R
3,657,464 A * 4/1972 Pascucci ..... G10D 7/08 84/380 R
5,419,229 A * 5/1995 Van Doren ..... G10D 9/02 84/383 R
7,608,768 B2 * 10/2009 Thanyakij ..... G10D 7/08 84/380 R
8,168,872 B1 * 5/2012 Fernandez ..... G10D 7/08 84/385 A
8,969,695 B1 * 3/2015 Fernandez ..... G10D 9/04 84/385 R
2014/0130653 A1 * 5/2014 Laidler ..... G10D 9/02 84/380 R

* cited by examiner

*Primary Examiner* — Robert W Horn
(74) *Attorney, Agent, or Firm* — Seed IP Law Group LLP

(57) ABSTRACT

A musical instrument including a tubular body having an internal tube with at least one tone hole disposed in a surface of said internal tube to provide air communication between a region inside the internal tube and a region outside of the internal tube; and a first outer shell member configured for attachment to an outer surface of the internal tube; at least one key member including a tone hole closure portion, an axle portion and a biasing member, the tone hole closure portion being movable relative to the tubular body between at least a closed position in which said tone hole closure portion covers the at least one tone hole disposed in the internal tube, and, an opened position in which said tone hole closure portion does not cover the tone hole disposed in the internal tube; wherein at least one of said axle portion and said biasing member are configured for location in a seating location provided by a seating portion disposed on at least one of the first outer shell member and the outer surface of the internal tube whereby the first outer shell member is configured for attachment to the outer surface of the internal tube so as to secure therebetween at least one of the axle portion and the biasing member in its seating location for operation of the key member.

23 Claims, 14 Drawing Sheets

MUSICAL INSTRUMENT AND METHOD OF ASSEMBLING SAME

TECHNICAL FIELD

The present invention relates to the field of woodwind and brass type musical instruments and methods of assembling same.

BACKGROUND OF THE INVENTION

Saxophones require a relatively high degree of time, skill and expertise to assemble due to the complexity of the key assemblies and the precise manner in which they must be attached to the body of the saxophone in order for the saxophone to play properly. Moreover, specialist tools, equipment and suitable fasteners are required to assemble a saxophone which also contributes to this overall complexity. Furthermore, as saxophones tend to be individually hand-crafted they must undergo bespoke tuning by persons with specialist skills and this also unduly incurs additional time during the manufacturing of such instruments.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a musical instrument including:

a tubular body having an internal tube with at least one tone hole disposed in a surface of said internal tube to provide air communication between a region inside the internal tube and a region outside of the internal tube; and a first outer shell member configured for attachment to an outer surface of the internal tube;

at least one key member including a tone hole closure portion, an axle portion and a biasing member, the tone hole closure portion being movable relative to the tubular body between at least a closed position in which said tone hole closure portion covers the at least one tone hole disposed in the internal tube, and, an opened position in which said tone hole closure portion does not cover the tone hole disposed in the internal tube;

wherein at least one of said axle portion and said biasing member are configured for location in a seating location provided by a seating portion disposed on at least one of the first outer shell member and the outer surface of the internal tube whereby the first outer shell member is configured for attachment to the outer surface of the internal tube so as to secure therebetween at least one of the axle portion and the biasing member in its seating location for operation of the key member.

Typically, the present invention may include at least one of a woodwind and a brass type musical instrument.

Preferably, the musical instrument may include a saxophone-type musical instrument.

Preferably, the first outer shell member and the internal tube may be configured for at least one of click-fitted, snap-fitted, press-fitted and friction-fitted attachment together.

Preferably, the first outer shell member may include a plurality of holes disposed thereon whereby when the first outer shell member is attached to the internal tube, the plurality of holes disposed in the first outer shell member are configured to align with the tone hole portions disposed in the internal tube.

Preferably, the tone hole closure portion may include a recess for receiving a silicone pad, whereby when the tone hole closure portion is arranged in the closed position the silicon pad seals the corresponding tone hole.

Preferably, the internal tube may include a single-piece tube that is molded from a polymeric material.

Preferably, at least one of the first outer shell member and the key member may be at least partially molded from a polymeric material.

Preferably, the present invention may include a thumb rest disposed on the tubular body, said thumb rest being movable between a plurality of positions relative to the tubular body.

Preferably, a second outer shell member may be configured for attachment with the internal tube so as to enclose a first portion of the thumb rest therebetween and allow a second portion of the thumb rest to extend outwardly from the tubular body, whereby said first portion of the thumb rest may be slidable in a space disposed between the second outer shell member and the internal tube so as to allow adjustment of the position of the thumb rest relative to the tubular body.

Preferably, the present invention may include an octave vent disposed in a surface of the internal tube whereby closure of said octave vent is configured to allow play of the musical instrument in a first octave and opening of the octave vent is configured to allow play of the musical instrument in a relatively higher octave.

Preferably, the present invention may include a mouthpiece having a body and a ligature movably attached to the body, said ligature being configured for movement relative to the body between at least a first configuration in which a reed may be inserted into position relative to the body for securement to the body, and, a second configuration in which the ligature is positioned to secure the reed against the body.

In a further broad form, the present invention provides a method of assembling a musical instrument, said method including steps of:

(i) providing a tubular body having:

an internal tube with at least one tone hole disposed in a surface of said internal tube to provide air communication between a region inside the internal tube and a region outside of the internal tube; and a first outer shell member configured for attachment to an outer surface of the internal tube; and (ii) providing at least one key member having a tone hole closure portion, an axle portion and a biasing member, the tone hole closure portion being configured for movement relative to the tubular body between at least a closed position in which said tone hole closure portion covers the at least one tone hole disposed in the internal tube, and, an opened position in which said tone hole closure portion does not cover the tone hole disposed in the internal tube; and (iii) locating at least one of said axle portion and said biasing member in a seating location provided by a seating portion disposed on at least one of the first outer shell member and the outer surface of the internal tube; and attaching the first outer shell member to the outer surface of the internal tube so as to secure therebetween at least one of the axle portion and the biasing member in its seating location for operation of the key member.

Typically, the musical instrument may include at least one of a woodwind and a brass type musical instrument.

Preferably, the musical instrument may include a saxophone-type musical instrument.

Preferably, the first outer shell member and the internal tube may be configured for at least one of click-fitted, snap-fitted, press-fitted and friction-fitted attachment together.

Preferably, the first outer shell member may include a plurality of holes disposed therein whereby when the first outer shell member is attached to the internal tube, the plurality of holes disposed in the first outer shell member may be configured to align with the tone hole portions disposed in the internal tube.

Preferably, the present invention may include a step of providing a recess in the tone hole closure portion for receiving a silicone pad, whereby when the tone hole closure portion is arranged in the closed position the silicon pad seals the corresponding tone hole.

Preferably, the internal tube may include a single-piece tube that may be molded from a polymeric material.

Preferably, at least one of the first outer shell member and the key member may be at least partially molded from a polymeric material.

Preferably, the present invention may include a step of providing a thumb rest disposed on the tubular body, said thumb rest being movable between a plurality of positions relative to the tubular body.

Preferably the present invention may include a step of providing a second outer shell member configured for attachment with the internal tube so as to enclose a first portion of the thumb rest therebetween and allow a second portion of the thumb rest to extend outwardly from the tubular body, whereby said first portion of the thumb rest is slidable in a space disposed between the second outer shell member and the internal tube so as to allow adjustment of the position of the thumb rest relative to the tubular body.

Preferably, the present invention may include an octave vent disposed in a surface of the internal tube whereby closure of said octave vent is configured to allow play of the musical instrument in a first octave and opening of the octave vent is configured to allow play of the musical instrument in a relatively higher octave.

Preferably, the present invention may include a step of providing a mouthpiece for use with the musical instrument, the mouthpiece including a body and a ligature movably attached to the body, said ligature being configured for movement relative to the body between at least a first configuration in which a reed may be inserted into position relative to the body for securement to the body, and, a second configuration in which the ligature is positioned to secure the reed against the body.

In a further broad form, the present invention provides a mouthpiece for a musical instrument, the mouthpiece having a body and a ligature movably attached to the body, said ligature being configured for movement relative to the body between at least a first configuration in which a reed may be inserted into position relative to the body for securement to the body, and, a second configuration in which the ligature is positioned to secure the reed against the body.

It would be appreciated that embodiments of the present invention may assist in providing at least one of the following advantages:

(i) in contrast to key assembly structures of conventional saxophones, embodiments of the present invention may alleviate exposure of the relatively fragile parts of the key assemblies such as pivot axles, biasing members and the like by internalising and protecting such parts from damage within the tubular body structure of the instrument;

(ii) the key members of embodiments of the present invention may be pressed directly on to the corresponding tone hole by the user's fingers which further alleviates the need for complex key assembly structures of conventional saxophones which tend to be susceptible to damage;

(iii) a saxophone-type musical instrument may be relatively quickly and easily assembled with relatively little skill and expertise required and alleviating the need for pins, screws, adhesives, fasteners and the like to secure the parts of the instrument together key members and other parts in place as these may be conveniently secured in position between either the upper and lower shell members and the internal tube surface by simply click-fitting upper and lower shell members in to position against the surface of the internal tube during manufacturing assembly. Moreover, the assembly process may be carried out without the need for any specialist tools as all parts may be click-fitted together by hand to ease and speed up the assembly process;

(iv) conventional saxophones require bespoke tuning during the manufacturing process and ongoing maintenance by virtue of the relative lack of uniformity and consistency in the assembly amongst such instruments. In contrast, saxophone type instruments produced in accordance with embodiments of the present invention may be inherently tuned by virtue of the design of the parts and assembly of the instrument, and, the tuning of the instruments is generally consistent amongst different instruments by virtue of the instrument parts being uniformly molded and attached in accordance with a uniformly defined configuration;

(v) in contrast to key member configurations of conventional saxophones, key members used in embodiments of the present invention may be conveniently arranged in a relatively linear configuration along the length of the tubular body which may improve a child's ability to learn to play the instrument and in seeking to provide a stepping stone for beginner players from playing a recorder to playing a conventional saxophone with more complex fingering requirements;

(vi) conventional type saxophones employ metallic parts which are susceptible to rust and other damage if not properly handled or maintained. In contrast, embodiments of the present invention utilise parts formed from polymeric materials and the like which provides for a more durable and lightweight instrument suitable for a child to carry and handle;

(vii) first and second outer shell members that are click-fitted to the outer surface of the internal tube may assist in protecting the internal tube from damage. Moreover as the instrument is modular in nature, the first and second outer shell members may be readily removed and replaced during maintenance of the instrument or to customize the instrument in a manner desirable to the user's specific tastes and preferences.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Preferred embodiments of the present invention will now be explained with reference to the FIGS. 1 to 15.

Figure 1:
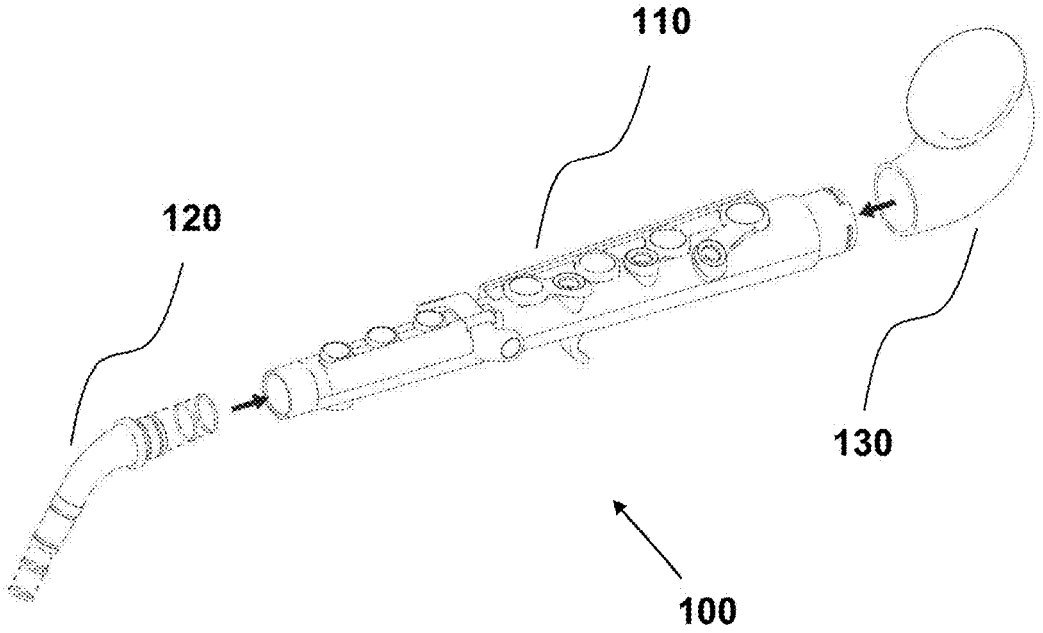
FIG. 1 shows an exploded perspective view of a saxophone-type musical instrument in accordance with an embodiment of the present invention.
Figure 4:
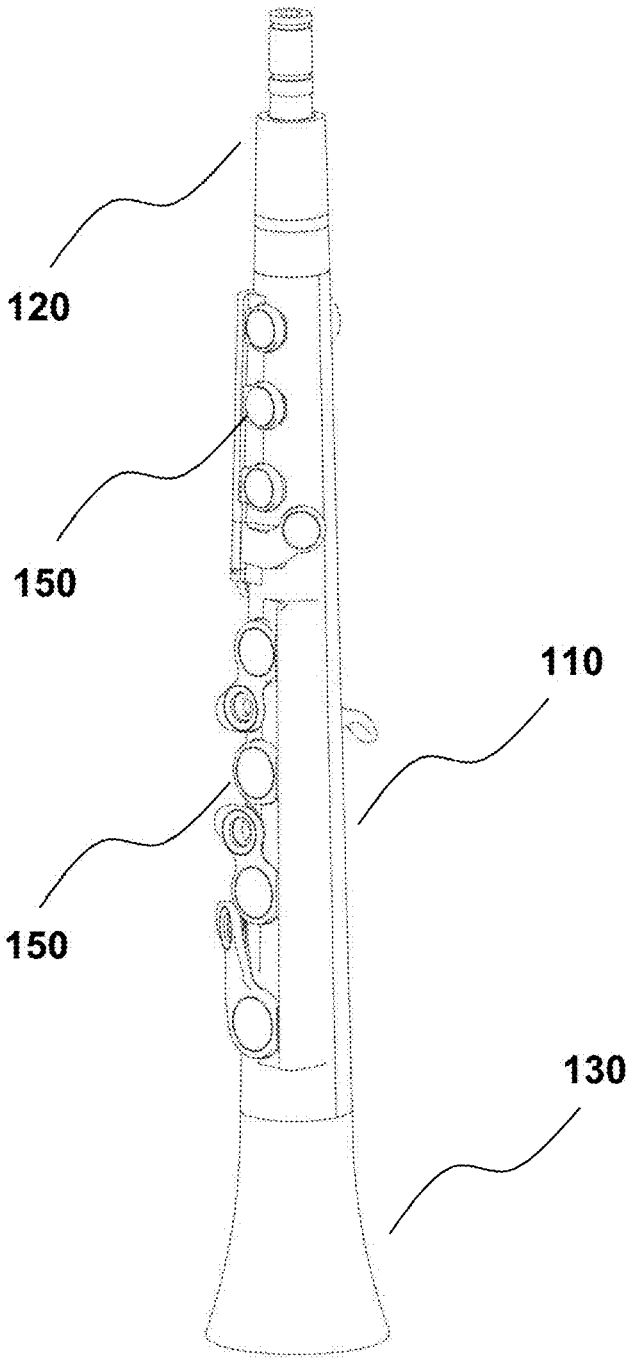
FIG. 4 shows a perspective view of the saxophone-type musical instrument with a straight neck and bell-member attached to opposing ends of the tubular body in accordance with an embodiment of the present invention.
Figure 5:
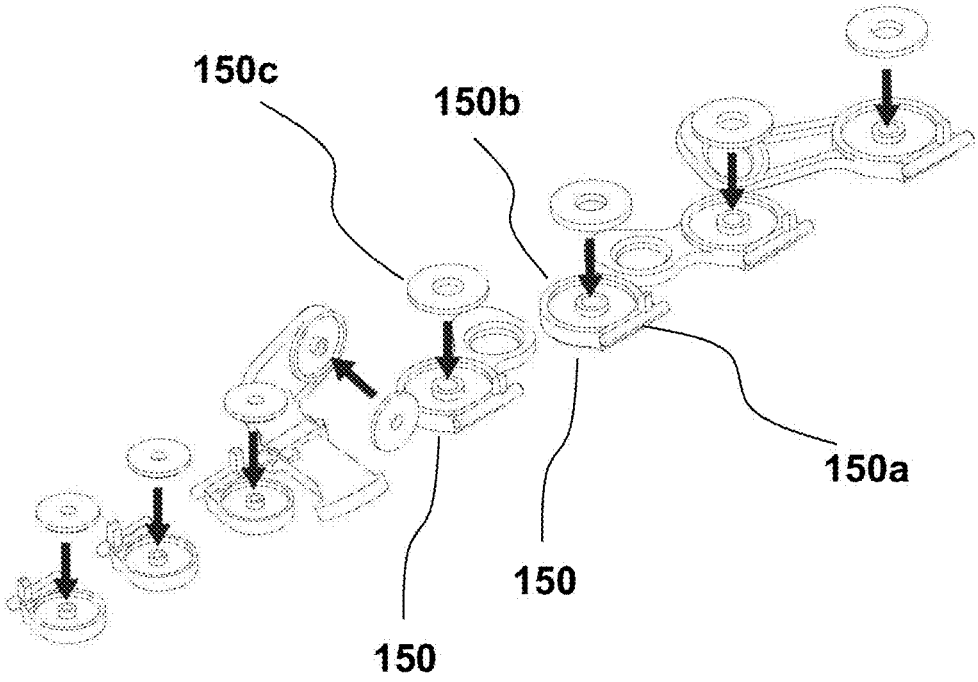
FIG. 5 shows a perspective view of silicone pads being inserted into recesses of key members before the key members are attached to the tubular body of a saxophone-type musical instrument in accordance with an embodiment of the present invention.

FIG. 1 shows an exploded perspective view of a saxophone-type musical instrument (100) in accordance with a first embodiment of the present invention. The musical instrument includes a tubular body (110) comprised by a single-piece internal tube (180) and upper and lower shell members (140*a*,140*b*) that are configured for click-fitted attachment to upper and lower regions of an outer surface of the internal tube (180) respectively so as to form an outer shell around the internal tube (180) when the musical instrument (100) is assembled. The tubular body (110) includes a first opened end configured for attachment to a bell section (130). A second opened end of the tubular body (110) is configured for attachment to a curved neck section (120) (which may also be formed as a straight neck as shown in FIG. 4).

Figure 2:
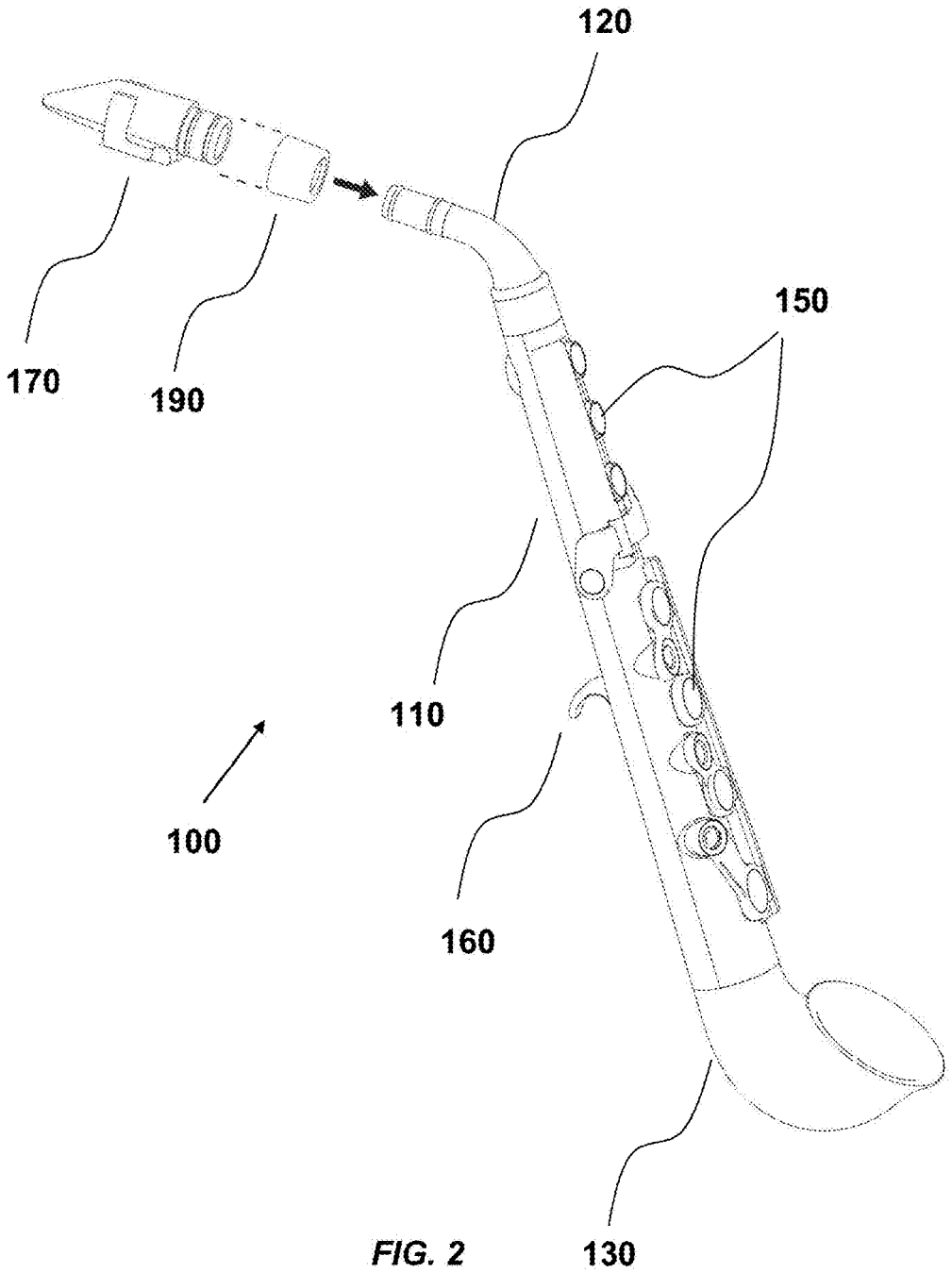
FIG. 2 shows an exploded perspective view of the saxophone-type musical instrument with the mouthpiece detached from the neck of the instrument.
Figure 3:
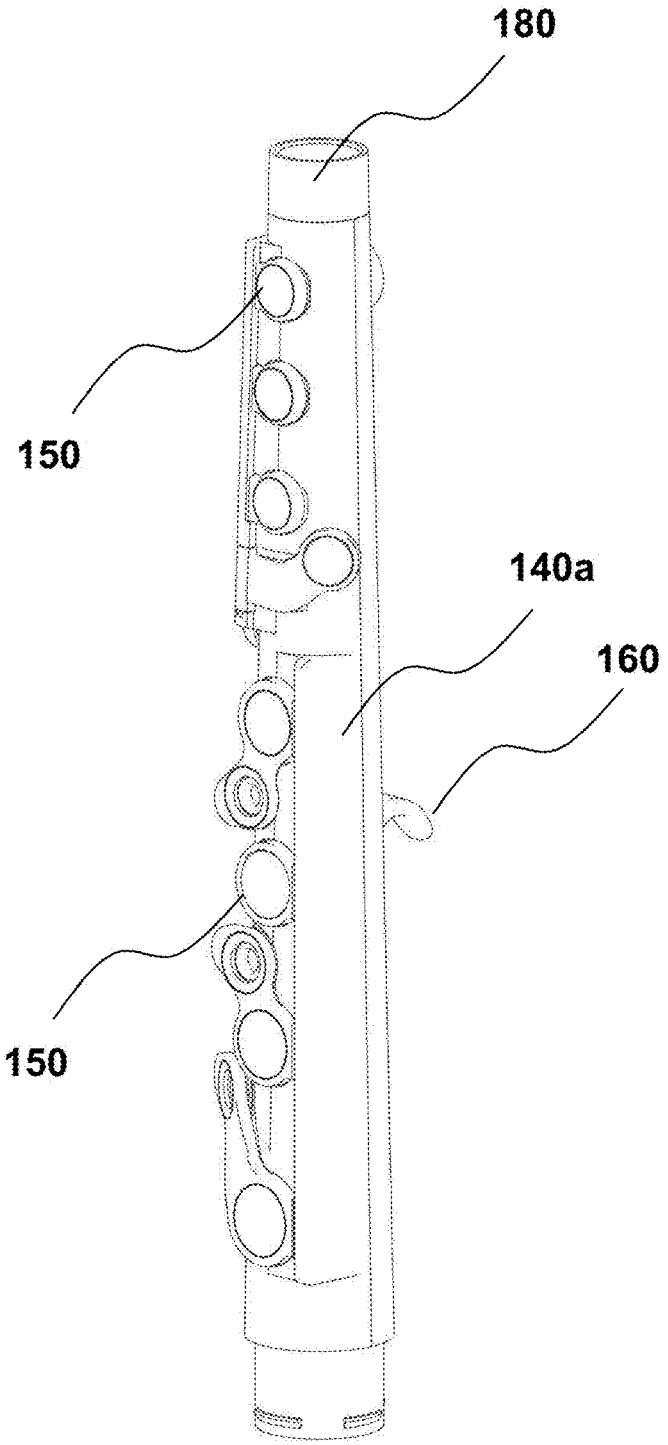
FIG. 3 shows a perspective view of the tubular body of the saxophone-type musical instrument in stand-alone fashion.
Figure 14:
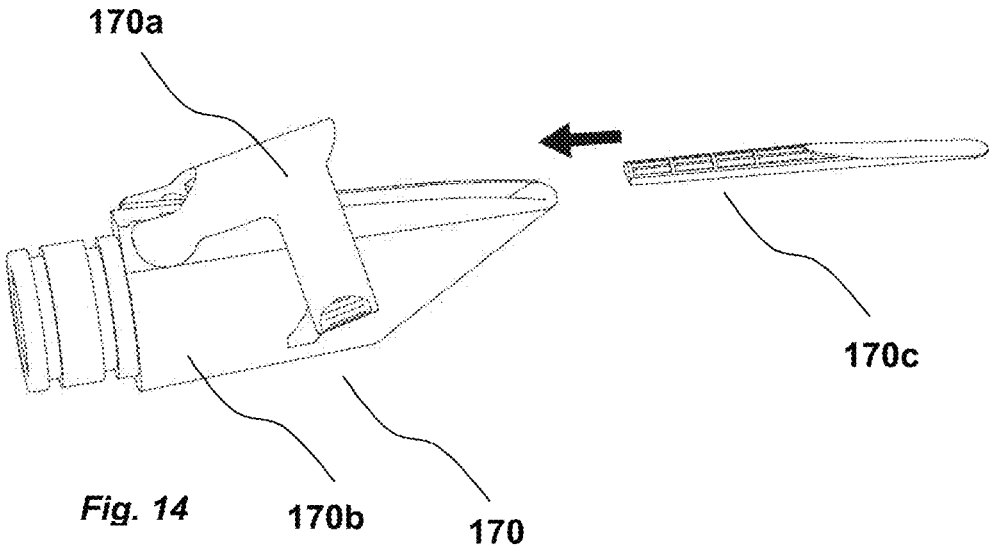
FIG. 14 shows a side view of the mouthpiece of FIG. 13. with a reed being shown being slidably inserted into position relative to the mouthpiece in readiness for clamping to the mouthpiece by the ligature, in accordance with an embodiment of the present invention.
Figure 15:
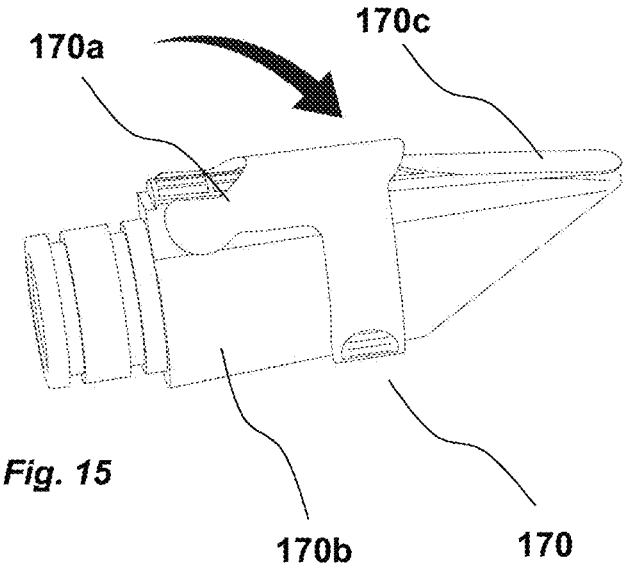
FIG. 15 shows a side view of the mouthpiece of FIG. 13. with the ligature rotated into a second configuration wherein the ligature clamps the reed against the mouthpiece to secure the reed in place.

The neck portion (120) is further configured for attachment to a mouthpiece (170) as shown in FIG. 2 via an adapter ring-piece (190). In this embodiment, the mouthpiece (170) includes a ligature (170*a*) that is integrally formed together with the body (170*b*) of the mouthpiece (170) and movable relative to the body (170*b*) between at least first configuration as shown in FIG. 14 in which a reed (170*c*) may be maneuvered into suitable position for securement to the mouthpiece body (170*b*), and, a second configuration as shown in FIG. 15 in which the ligature (170*a*) is moved in to position to clamp the reed (170*c*) against the mouthpiece body (170*b*) so as to hold the reed (170*c*) in a secured position relative to the mouthpiece body (170*b*). Advantageously, the integrally formed ligature (170*a*) of the mouthpiece (170) may assist in allowing quick attachment and detachment of a reed (170*c*) relative to the mouthpiece (170). Additionally, because the ligature (170*a*) is integrally formed as part of the mouthpiece (170), this alleviates risk of the ligature (170*a*) being inadvertently misplaced from the mouthpiece (170) as may be the case with conventional type mouthpieces used in this context. Furthermore, the novel configuration of the mouthpiece (170) may allow the mouthpiece (170) to be more easily operated in one hand if necessary.

The single-piece internal tube (180) of the tubular body (110) includes opened first and second ends and outwardly protruding tone hole portions (180*a*) disposed along a sidewall of the internal tube (180). Whilst it is possible that in certain embodiments, the internal tube (180) may be formed from separate pieces that are bonded together to form the internal tube, a single-piece internal tube (180) is preferably utilised in embodiments of the instrument (100) to assist in enhancing sound integrity during playing of the instrument. The internal tube (180) may for instance be formed as a single-piece by way of injection molding an ABS material or any other suitable polymeric material.

The musical instrument (100) includes a plurality of key members (150) each being injection molded from an ABS material as a single piece to include an axle portion (150*a*) and a tone hole closure portion (150*b*) for covering corresponding tone holes portions (180*a*). The key members (150) are configured for attachment to the tubular body (110) so as to be pivotable relative to the tubular body (110) about the axle portions (150*a*) between at least an opened position whereby the tone hole closure portions (150*b*) do not cover the corresponding tone holes portions (180*a*) of the internal tube (180), and, a closed position whereby the tone hole closure portions (150*b*) cover their corresponding tone holes portions (180*a*).

Figure 6:
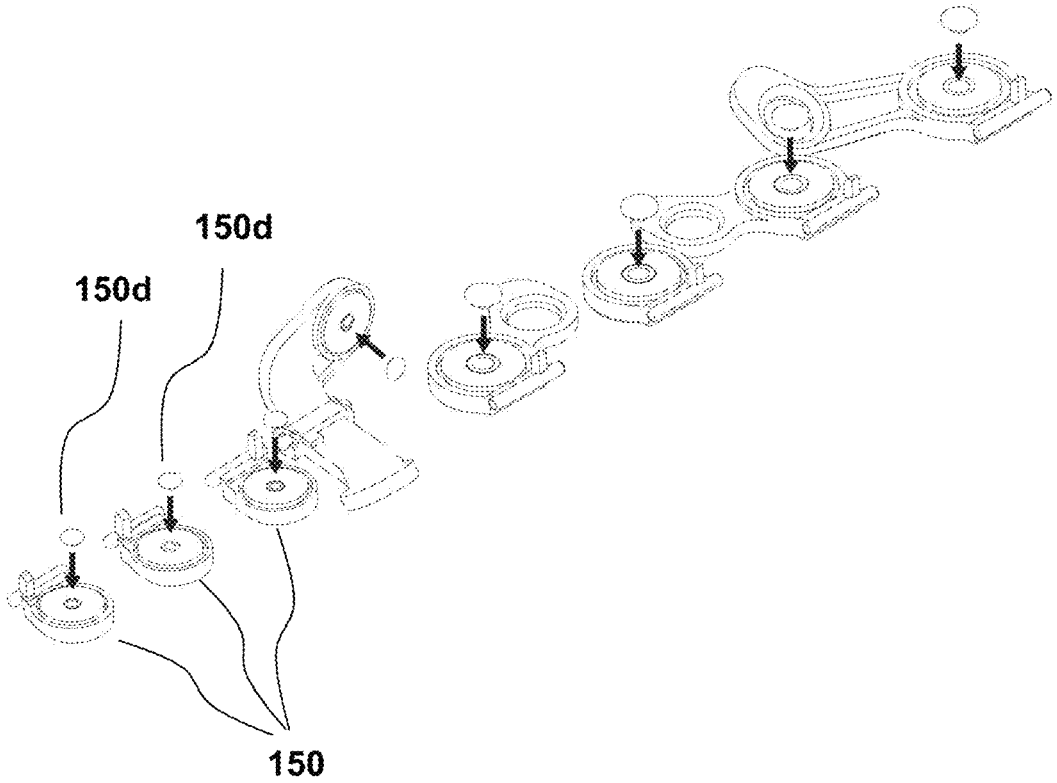
FIG. 6 shows a perspective view of silicone pads being secured in placed within recesses of key members by insertion of ABS pegs, in accordance with an embodiment of the present invention.
Figure 7:
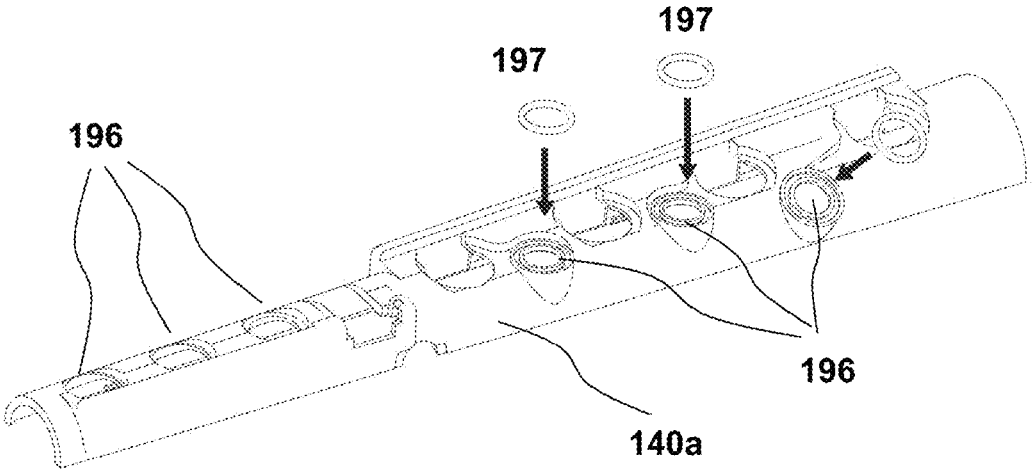
FIG. 7 shows a perspective view of the upper shell member with o-rings being inserted into place within holes in the upper shell member.

The tone hole closure portions (150*b*) include circular recesses disposed therein which are shaped and dimensioned to snugly receive circular-shaped compression molded silicone pads (150*c*). The silicone pads (150*c*) are secured within the recesses by pegs (150*d*) as shown in FIG. 6 which are also formed from an ABS material. Conveniently, the pads (150*c*) may be quickly and easily replaced if required by dislodging the ABS peg (150*d*) and releasing the pad (150*c*) from its recess. When the key members (150) are pivoted around their axle portions (150*a*) in to their closed positions the silicone pads (150*c*) substantially seal the corresponding tone holes portions (180*a*).

Figure 8:
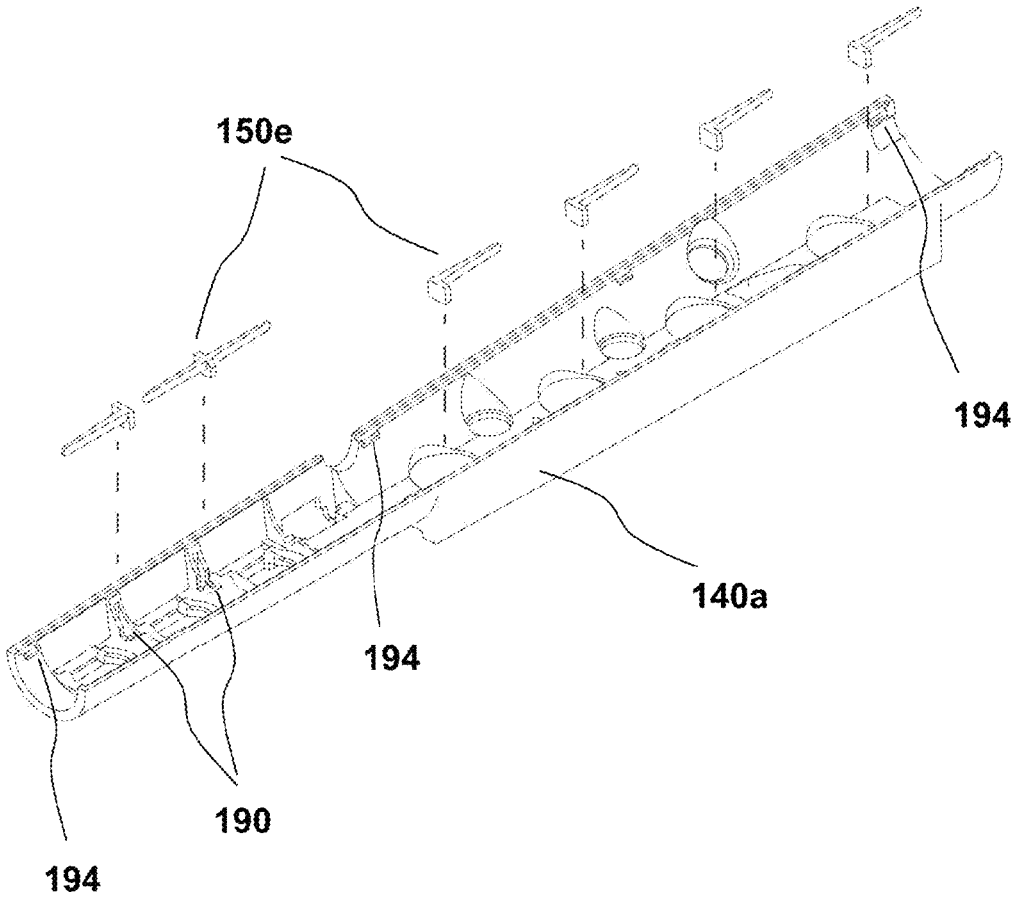
FIG. 8 shows a perspective view of a lower surface of the upper shell member with biasing members of the key members being inserted into location slots disposed on the lower surface of the upper shell member, in accordance with an embodiment of the present invention.
Figure 9:
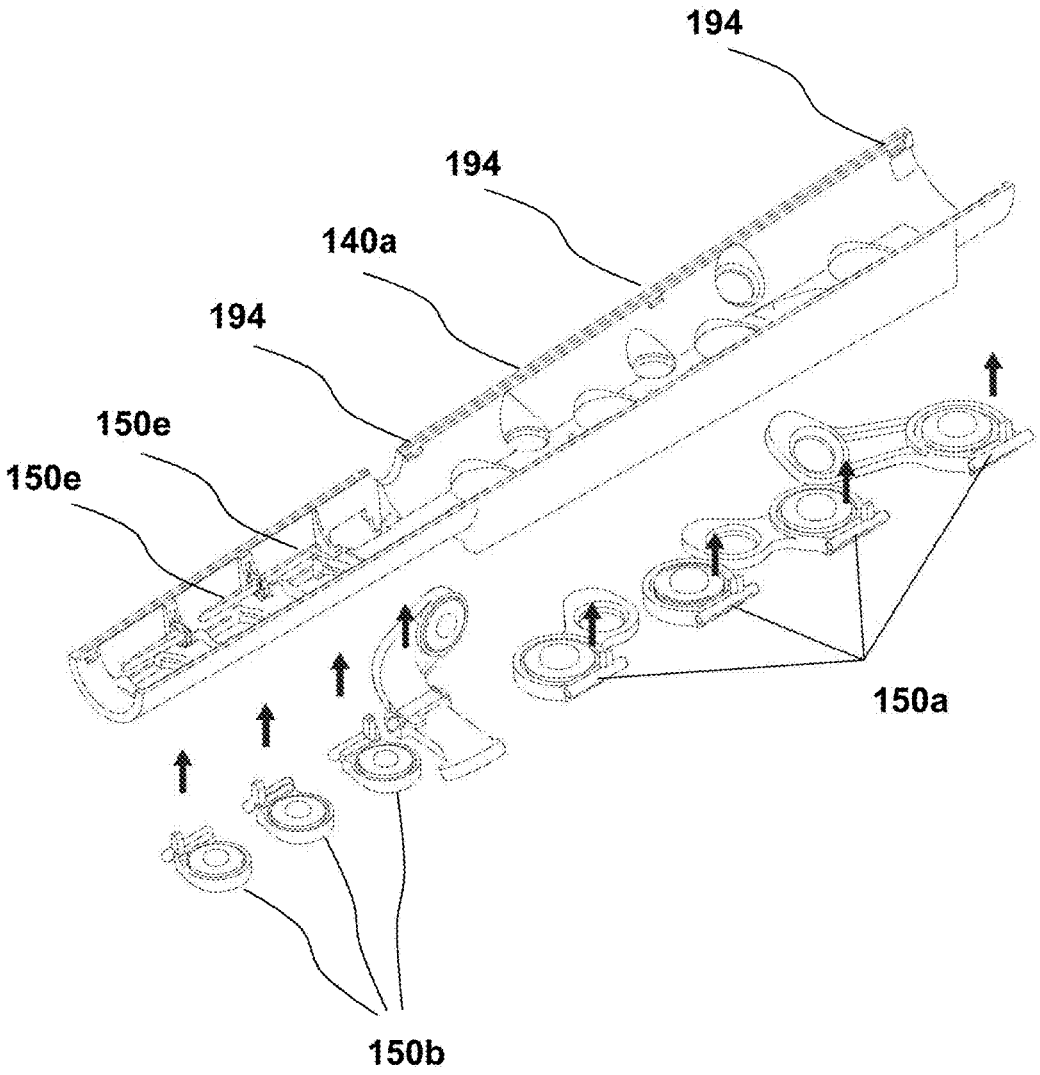
FIG. 9 shows a perspective view of a lower surface of the upper shell member showing axle portions of the key members in the process of being passed through corresponding holes in the upper shell member before the upper shell member and key members are lowered together for attachment to the internal tube, in accordance with an embodiment of the present invention.
Figure 10:
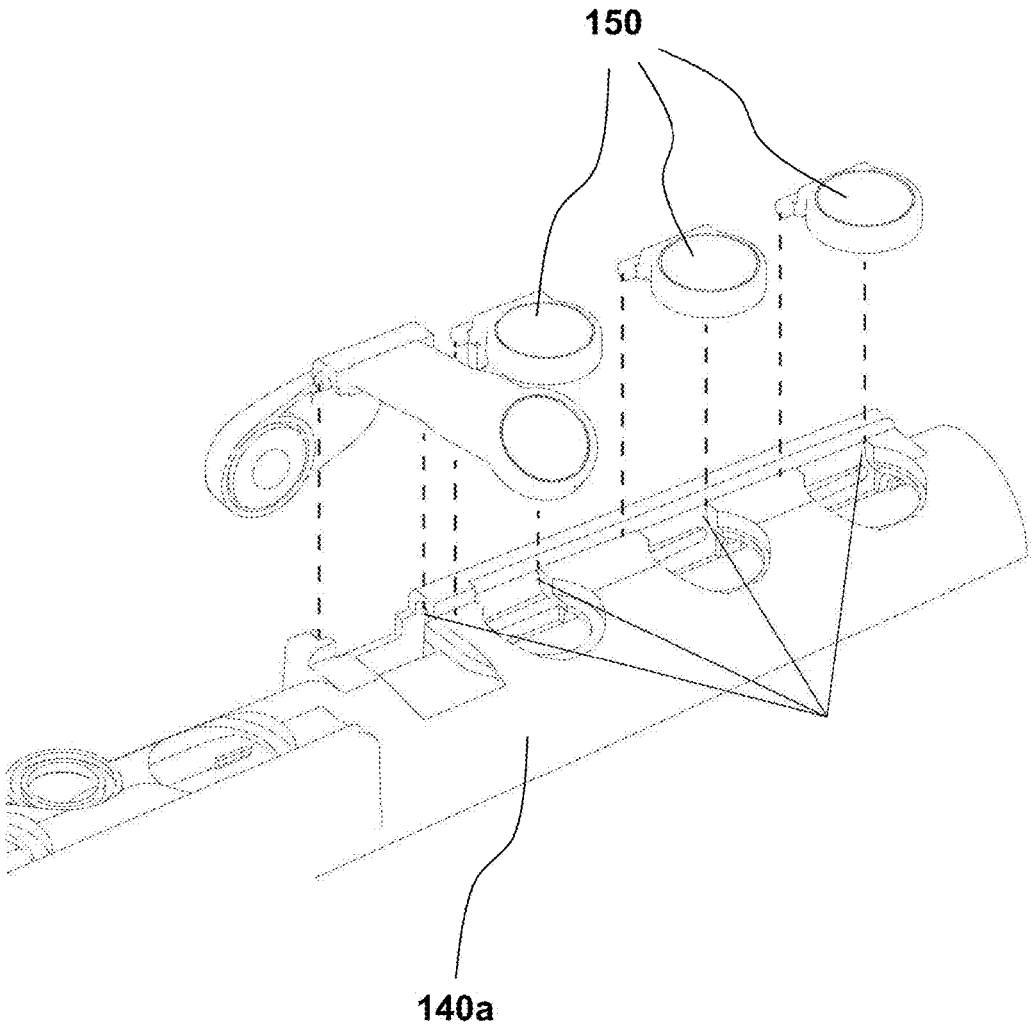
FIG. 10 shows a perspective view of a top surface of the upper shell member showing axle portions of the key members in the process of being passed through corresponding holes in the upper shell member before the upper shell member and key members are lowered together for attachment to the internal tube, in accordance with an embodiment of the present invention.
Figure 11:
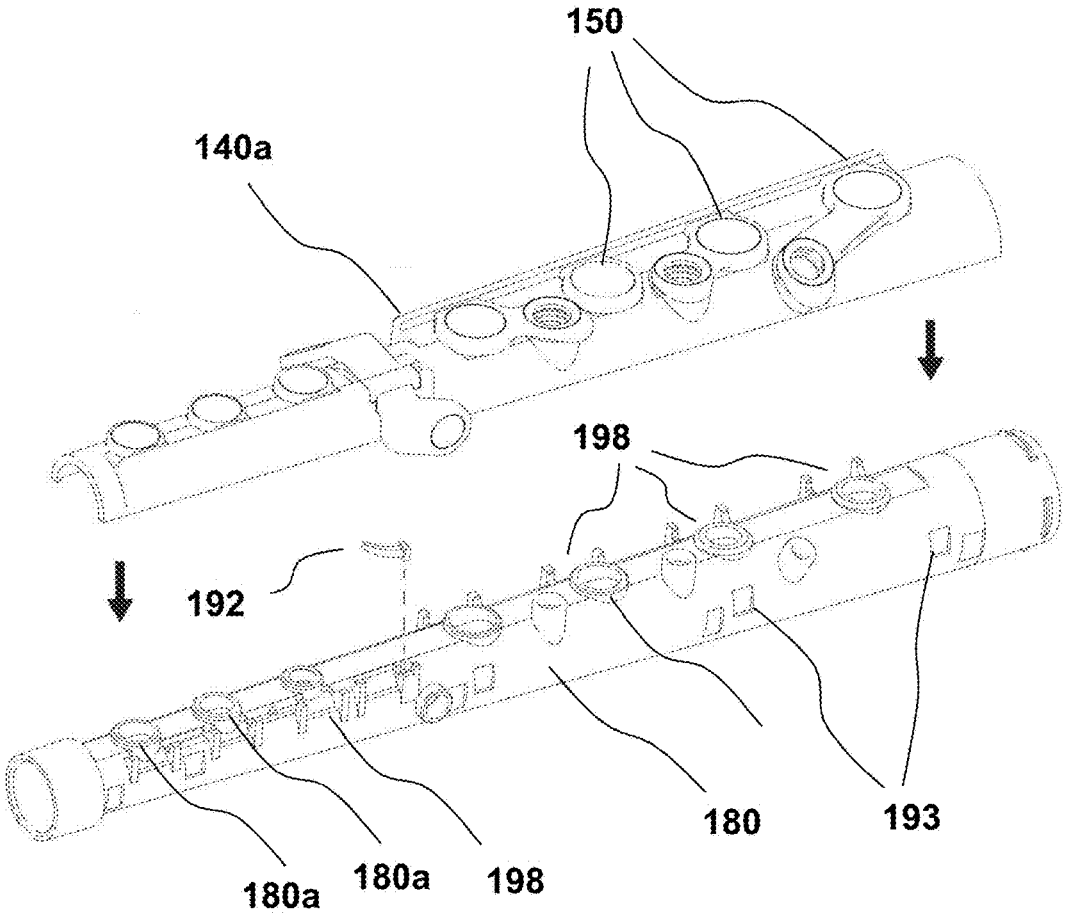
FIG. 11 shows a top perspective view of the upper shell member with key members suitably located thereon, with the upper shell member in the process of being lowered into click-fitting attachment to an outer surface of the internal tube to hold the axle portions and biasing members of the key members in place, in accordance with an embodiment of the present invention.

The key members (150) are each biased into their opened positions relative to their corresponding tone holes portions (180*a*) by biasing members (150*e*). In this embodiment, the biasing members (150*e*) are comprised by Polyoxymethylene (POM) spring members seated within location slots (190) of the upper shell (140*a*) as shown in FIGS. 8 and 9. In this embodiment the location slot (191) of the biasing member (192) for a G# key is disposed on the upper surface of the internal tube (180) as shown in FIG. 11.

The upper and lower shell members (140*a*,140*b*) include click-fitting attachment tabs (194) configured for click-fitting, press-fitting or snap-fitting attachment with corresponding notches (193) disposed on upper and lower surfaces of the internal tube (180) respectively. The upper shell member (140*a*) includes a plurality of holes (196) disposed thereon which are configured for concentric alignment with corresponding protruding tone holes portions (180*a*) outwardly extending from the surface of the internal tube (180) when the upper shell member (140*a*) is attached to the internal tube (180). In some embodiments when the upper shell member (140*a*) is attached to the internal tube (180), the protruding tone hole portions (180*a*) of the internal tube (180) extend at least partially into and are received within the peripheries of the corresponding holes (196) in the upper shell member (140*a*) such that the aligned holes in the upper shell member (140*a*) may conveniently serve as a locating means for locating the upper shell member (140*a*) in its proper position relative to the internal tube (180) during assembly. The holes (196) in the upper shell member (140*a*) may also be suitably recessed to complement shape and dimensions of the tone hole closure portions (150*b*) of the corresponding key members (150) when the tone hole closure portions (150*b*) are pivoted into closed positions to cover their respective tone holes of the internal tube. This may also assist in locating the key members (150) in place in the assembled musical instrument (100). Additionally, during assembly of the instrument, O-rings (197) may be inserted in position within the peripheries of the holes (196) in the upper shell member (140*a*) to assist in sealing of the tone holes portions (180*a*) when the tone hole closure portions (150*b*) are arranged in their closed positions.

The axle portions (150*a*) and biasing members (150*e*) of each key member (150) are configured for location in seating locations provided by seating portions (198) disposed on the surface of the internal tube (180) such that when the upper shell member (140*a*) is attached to the outer surface of the internal tube (180), the attached upper shell member (140*a*) and the surface of the internal tube (180) collectively secure the axle portions (150*a*) and biasing members (150*e*) therebetween in their respective seating locations. To achieve this, during assembly of the instrument, the biasing members (150*e*) are first positioned in their respective seating locations (which comprise location slots (190) disposed on the surface of the upper shell member (140*a*) facing inwardly towards the internal tube (180) when attached in this embodiment) and the axle portions (150*a*) of the key members (150) are passed through their corresponding holes (196) in the upper shell member (140*a*) with the tone hole closure portions (150*b*) of the key members (150) being arranged in place to cover their respective holes (196) disposed on the upper shell member (140*a*) as shown. The upper shell member (140*a*) and key members (150) are then lowered together in this arrangement towards the upper surface of the internal tube (180) as shown in FIG. 11 so that the axle portions (150*a*) of the key members (150) are able to be seated in the seating locations defined by the seating portions (198). The click-fitting attachment members of the upper shell member (140*a*) are then click-fitted into attachment with corresponding attachment notches (193) disposed on the outer surface of the internal tube (180) to effect click-fitting attachment of the upper shell member (140*a*) and the internal tube (180). The axle portions (150*a*) of the key members (150) are thereafter able to pivot within the seating locations (198) whilst being securely held within their seating locations (198). The biasing members (150*e*) are configured to abut against and urge the key members (150) into their opened positions relative to their corresponding tone holes portions (180*a*). Thereby, when the upper shell member (140*a*) is attached to the upper surface of the internal tube (180), the axle portions (150*a*) and the biasing members (150*e*) of the key members (150) are internalised between the structure of the upper shell member (140*a*) and internal tube (180) which alleviates potential exposure of these relatively fragile parts to damage as may tend to be the case with key assemblies of conventional type saxophones. Conveniently, it is noted that a musical instrument (100) may be relatively quickly and easily assembled with relatively little skill required and without requiring the use of pins, screws, adhesives, fasteners and the like to secure the key member assemblies in place as the key assemblies or portions thereof are able to be securely held in place between the attached upper shell member (140*a*) and internal tube (180) surfaces.

In a conventional saxophone, an octave vent is disposed on the neck which is able to be controllably covered by a mechanical assembly comprising a flat metal octave key. When operated by the user, the flat metal octave key is typically levered into position to cover the octave vent which has the effect of changing the shifting the sound output of the saxophone to an upper register. In contrast, in this embodiment of the present invention, a novel configuration is provided for shifting the sound output of the musical instrument to an upper register whereby an octave key is dispensed with, the octave vent (200) is now positioned on the internal tube (180) of the instrument and configured to be selectably closed by a user's finger or thumb directly covering the octave vent (200) during playing of the instrument. Closure of the octave vent is configured to allow play of the musical instrument in a first octave and opening of the octave vent is configured to allow play of the musical instrument in a relatively higher octave. This novel octave changing arrangement may provide greater ease for a child's hand to effect an octave change in the context of saxophone type instruments. It may also alleviate overall complexity, cost of construction, and cost of ongoing repair of a saxophone type musical instrument formed in accordance with embodiments of the present invention by virtue of simplified ergonomic configuration and minimal moving parts.

Figure 12:
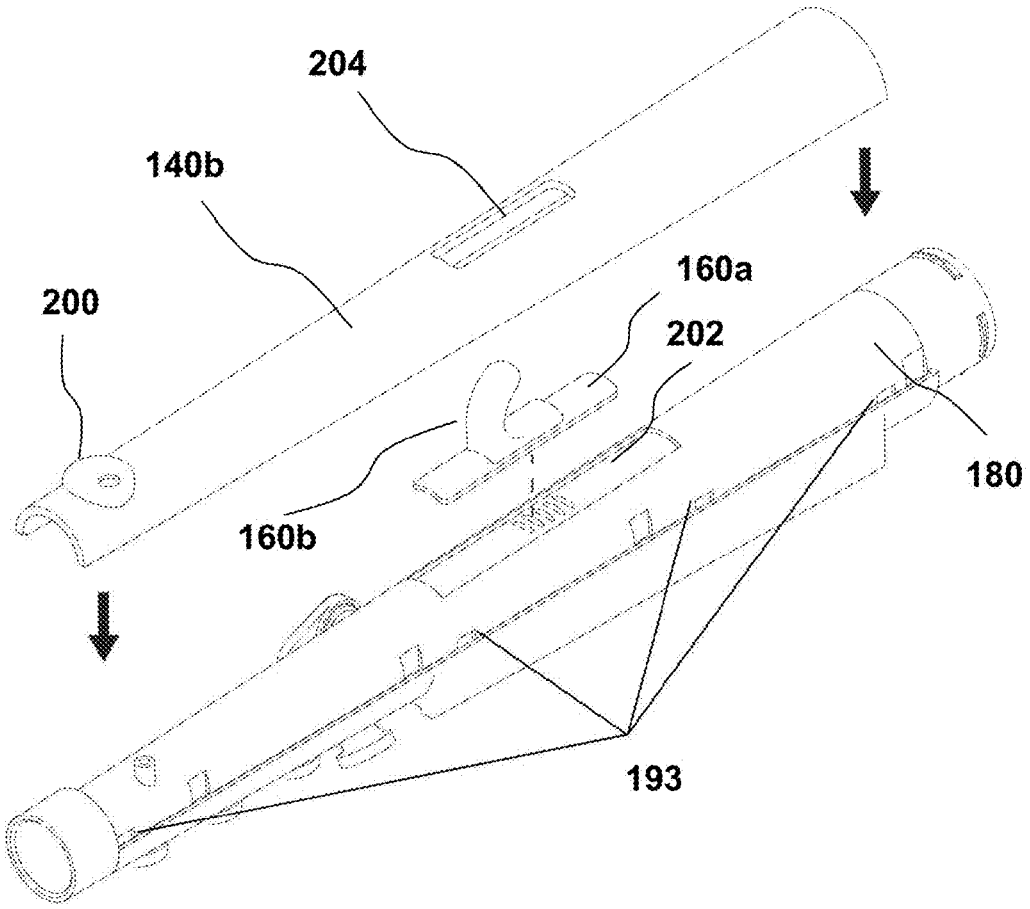
FIG. 12 shows a perspective view of the lower shell member being click-fitted to a lower surface of the internal tube to secure an adjustable thumb rest in place, in accordance with an embodiment of the present invention.
Figure 13:
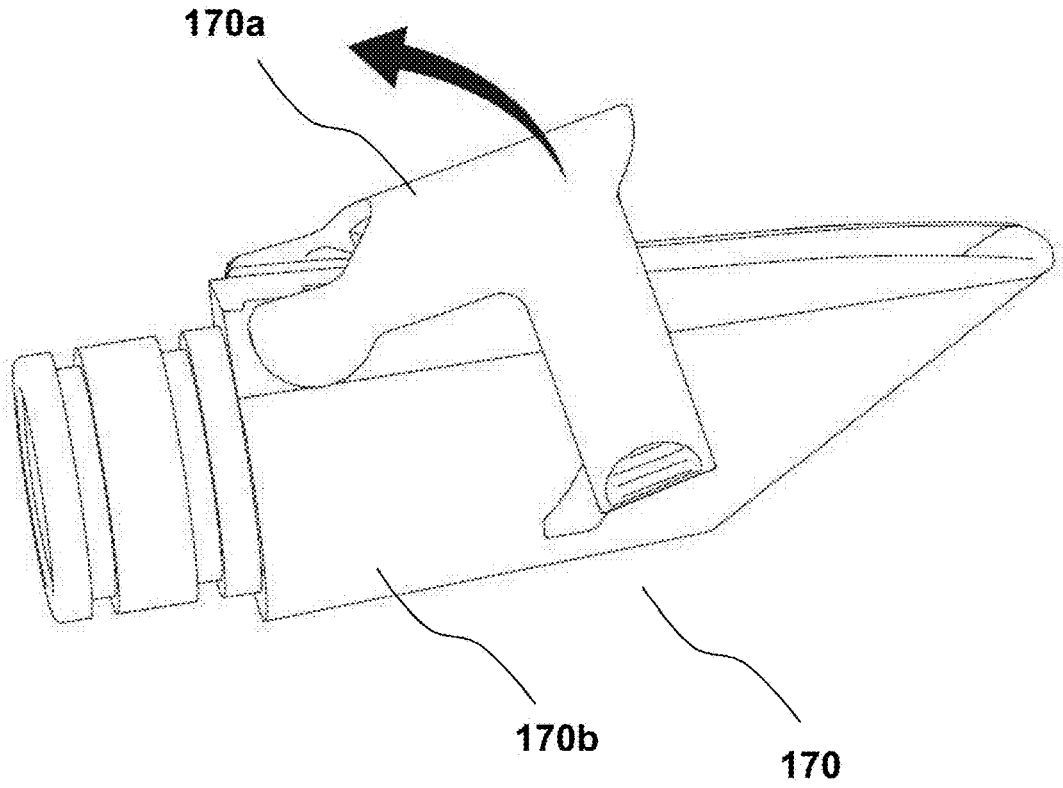
FIG. 13 shows a side view of a mouthpiece for use with a saxophone-type instrument, the mouthpiece having an integrally formed ligature that is rotatably movable into a first configuration whereby a reed is able to be maneuvered into position for securement to the mouthpiece, in accordance with an embodiment of the present invention.

Also in conventional saxophones, a hook-shaped thumb rest is disposed on an underside of the main body of the musical instrument upon which a user may typically hook a thumb to support the weight of the saxophone during playing of the saxophone. In embodiments of the present invention, a novel thumb rest (160) arrangement is disposed on the underside of the tubular body (180) which is slidably adjustable to accommodate different user holding preferences and enhance user comfort during playing of the instrument. Conveniently, the adjustable thumb rest (160) may also be easily and quickly attached to the saxophone type musical instrument during manufacturing assembly as shown in FIG. 12 As shown, the thumb rest (160) includes a rectangular-shaped portion (160*a*) configured for slidable movement along a sliding axis within a rectangular-shaped recess (202) disposed on a lower surface of the internal tube (180). A hooked thumb rest portion (160*b*) is integrally formed with the rectangular-shaped portion (160*a*) from an injection molded ABS material and extends substantially perpendicularly from the rectangular-shaped portion (160*a*). To secure the adjustable thumb rest (160) in place, when the rectangular-shaped portion (160*a*) of the thumb rest (160) is located within the corresponding recess (202) in the lower surface of the internal tube (180), the lower shell member (140*b*) is positioned over the thumb rest (160) so as to secure the lower shell member (140*b*) into click-fitting engagement with the internal tube (180). The lower shell member (140*b*) includes a slot (204) that is shaped and dimensioned to allow the hooked thumb rest portion (160*b*) to protrude therethrough and move freely within the slot during use. Conveniently, the novel adjustable thumb rest (160) lends itself relatively well for inclusion in embodiments of the present invention as it may be secured in place for slidable movement relatively quickly and easily with relatively little skill required and without requiring the use of pins, screws, adhesives, fasteners and the like to secure the thumb rest in place.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A musical instrument comprising:

a tubular body having an internal tube with at least one tone hole disposed in a surface of said internal tube to provide air communication between a region inside the internal tube and a region outside of the internal tube; and a first outer shell member configured for attachment to an outer surface of the internal tube;

at least one key member including a tone hole closure portion, an axle portion and a biasing member, the tone hole closure portion being movable relative to the tubular body between at least a closed position in which said tone hole closure portion covers the at least one tone hole disposed in the internal tube, and, an opened position in which said tone hole closure portion does not cover the tone hole disposed in the internal tube;

at least one of said axle portion and said biasing member are configured for location in a seating location provided by a seating portion disposed on at least one of the first outer shell member and the outer surface of the internal tube whereby the first outer shell member is configured for attachment to the outer surface of the internal tube so as to secure therebetween at least one of the axle portion and the biasing member in its seating location for operation of the key member, wherein the first outer shell member includes a plurality of holes disposed thereon whereby when the first outer shell member is attached to the internal tube, the plurality of holes disposed in the first outer shell member are configured to align with the tone hole portions disposed in the internal tube.

2. A musical instrument as claimed in claim 1 wherein the musical instrument is at least one of a woodwind and a brass type musical instrument.

3. A musical instrument as claimed in claim 1 wherein the musical instrument is a saxophone-type musical instrument.

4. A musical instrument as claimed in claim 1 wherein the first outer shell member and the internal tube are configured for at least one of click-fitted, snap-fitted, press-fitted and friction-fitted attachment together.

5. A musical instrument as claimed in claim 1 wherein the tone hole closure portion includes a recess for receiving a silicone pad, whereby when the tone hole closure portion is arranged in the closed position the silicon pad seals the corresponding tone hole.

6. A musical instrument as claimed in claim 1 wherein the internal tube is a single-piece tube that is molded from a polymeric material.

7. A musical instrument as claimed in claim 1 wherein at least one of the first outer shell member and the key member are at least partially molded from a polymeric material.

8. A musical instrument as claimed in claim 1 further comprising: an octave vent disposed in a surface of the internal tube whereby closure of said octave vent is configured to allow play of the musical instrument in a first octave and opening of the octave vent is configured to allow play of the musical instrument in a relatively higher octave.

9. A musical instrument as claimed in claim 1 further comprising: a mouthpiece having a body and a ligature movably attached to the body, said ligature being configured for movement relative to the body between at least a first configuration in which a reed may be inserted into position relative to the body for securement to the body, and, a second configuration in which the ligature is positioned to secure the reed against the body.

10. A musical instrument, comprising:

a tubular body having an internal tube with at least one tone hole disposed in a surface of said internal tube to provide air communication between a region inside the internal tube and a region outside of the internal tube; and a first outer shell member configured for attachment to an outer surface of the internal tube;

at least one key member including a tone hole closure portion, an axle portion and a biasing member, the tone hole closure portion being movable relative to the tubular body between at least a closed position in which said tone hole closure portion covers the at least one tone hole disposed in the internal tube, and, an opened position in which said tone hole closure portion does not cover the tone hole disposed in the internal tube;

at least one of said axle portion and said biasing member are configured for location in a seating location provided by a seating portion disposed on at least one of the first outer shell member and the outer surface of the internal tube whereby the first outer shell member is configured for attachment to the outer surface of the internal tube so as to secure therebetween at least one of the axle portion and the biasing member in its seating location for operation of the key member; and a thumb rest disposed on the tubular body, said thumb rest being movable between a plurality of positions relative to the tubular body.

11. A musical instrument as claimed in claim 10 wherein the first outer shell member includes a plurality of holes disposed thereon whereby when the first outer shell member is attached to the internal tube, the plurality of holes disposed in the first outer shell member are configured to align with the tone hole portions disposed in the internal tube.

12. A musical instrument as claimed in claim 10, further comprising: a second outer shell member configured for attachment with the internal tube so as to enclose a first portion of the thumb rest therebetween and allow a second portion of the thumb rest to extend outwardly from the tubular body, whereby said first portion of the thumb rest is slidable in a space disposed between the second outer shell member and the internal tube so as to allow adjustment of the position of the thumb rest relative to the tubular body.

13. A method of assembling a musical instrument, said method including steps of:

(i) providing a tubular body having:

an internal tube with at least one tone hole disposed in a surface of said internal tube to provide air communication between a region inside the internal tube and a region outside of the internal tube; and a first outer shell member configured for attachment to an outer surface of the internal tube; and (ii) providing at least one key member having a tone hole closure portion, an axle portion and a biasing member, the tone hole closure portion being configured for movement relative to the tubular body between at least a closed position in which said tone hole closure portion covers the at least one tone hole disposed in the internal tube, and, an opened position in which said tone hole closure portion does not cover the tone hole disposed in the internal tube; and (iii) locating at least one of said axle portion and said biasing member in a seating location provided by a seating portion disposed on at least one of the first outer shell member and the outer surface of the internal tube; and attaching the first outer shell member to the outer surface of the internal tube so as to secure therebetween at least one of the axle portion and the biasing member in its seating location for operation of the key member, wherein the first outer shell member includes a plurality of holes disposed therein whereby when the first outer shell member is attached to the internal tube, the plurality of holes disposed in the first outer shell member are configured to align with the tone hole portions disposed in the internal tube.

14. A method as claimed in claim 13 wherein the musical instrument is at least one of a woodwind and a brass type musical instrument.

15. A method as claimed in claim 13 wherein the musical instrument is a saxophone-type musical instrument.

16. A method as claimed in claim 13 wherein the first outer shell member and the internal tube are configured for at least one of click-fitted, snap-fitted, press-fitted and friction-fitted attachment together.

17. A method as claimed in claim 13 including providing a recess in the tone hole closure portion for receiving a silicone pad, whereby when the tone hole closure portion is arranged in the closed position the silicon pad seals the corresponding tone hole.

18. A method as claimed in claim 13 wherein the internal tube is a single-piece tube that is molded from a polymeric material.

19. A method as claimed in claim 13 wherein at least one of the first outer shell member and the key member are at least partially molded from a polymeric material.

20. A method as claimed in claim 13 further comprising: a thumb rest disposed on the tubular body, said thumb rest being movable between a plurality of positions relative to the tubular body.

21. A method as claimed in claim 20, further comprising: providing a second outer shell member configured for attachment with the internal tube so as to enclose a first portion of the thumb rest therebetween and allow a second portion of the thumb rest to extend outwardly from the tubular body, whereby said first portion of the thumb rest is slidable in a space disposed between the second outer shell member and the internal tube so as to allow adjustment of the position of the thumb rest relative to the tubular body.

22. A method as claimed in claim 13, further comprising: providing an octave vent disposed in a surface of the internal tube whereby closure of said octave vent is configured to allow play of the musical instrument in a first octave and opening of the octave vent is configured to allow play of the musical instrument in a relatively higher octave.

23. A method as claimed in claim 13, further comprising: providing a mouthpiece for use with the musical instrument, the mouthpiece including a body and a ligature movably attached to the body, said ligature being configured for movement relative to the body between at least a first configuration in which a reed may be inserted into position relative to the body for securement to the body, and, a second configuration in which the ligature is positioned to secure the reed against the body.

* * * * *